US005167738A

United States Patent [19]

Bichot et al.

[11] Patent Number: 5,167,738

[45] Date of Patent: Dec. 1, 1992

[54] RECYCLING OF FIBROUS PRODUCTS IN A PRODUCTION LINE FOR MANUFACTURING MATS FROM FIBERS

[75] Inventors: Bernard Bichot, Clermont; Gerardus P. M. Van Oers; Cornelis G. A. Bakx, both of Etten-Leur, all of France

[73] Assignee: Isover Saint-Gobain, Courbevoie, France

[21] Appl. No.: 713,281

[22] Filed: Jun. 11, 1991

[30] Foreign Application Priority Data

Jun. 12, 1990 [FR] France ..... 90 07261

[51] Int. Cl.[5] ..... B27N 3/00

[52] U.S. Cl. ..... 156/62.4; 65/4.4; 65/9; 156/62.6

[58] Field of Search ..... 65/4.4, 9, 6, 14; 156/62.4, 62.6, 62.8; 264/8, 12

[56] References Cited

U.S. PATENT DOCUMENTS

| | | | |
|---|---|---|---|
| 2,785,728 | 3/1957 | Slayter et al. | 156/62.4 X |
| 2,904,453 | 9/1959 | Labino | 65/4.4 X |
| 3,616,030 | 10/1971 | Jumentier et al. | 65/4.4 X |
| 3,850,601 | 11/1974 | Stapleford et al. | 65/9 X |
| 4,243,446 | 1/1981 | Mathey | 156/62.4 |
| 4,495,119 | 1/1985 | Chung | 264/37 |
| 4,576,620 | 3/1986 | Porter et al. | 65/9 |

FOREIGN PATENT DOCUMENTS

| | | | |
|---|---|---|---|
| 2173523 | 10/1986 | United Kingdom | 65/4.4 |

*Primary Examiner*—Robert L. Lindsay
*Attorney, Agent, or Firm*—Oblon, Spivak, McClelland, Maier & Neustadt

[57] ABSTRACT

For producing mineral fiber mats, the flock emanating from the waste to be recycled is stored and classified according to density. Furthermore, the reintroduced quantities are precisely measured and the flock is caused to burst open. Thus it is possible to reintroduce substantially larger quantities without altering either the appearance or the characteristics of the product obtained.

6 Claims, 3 Drawing Sheets

17
18
19
20
21
22
23
24
25
26
27
28
29
30
31
32
33
34
35
36
37
38
39
40
42
43
44
45
46
47
3
4
5
7
8
9
10
11

RECYCLING OF FIBROUS PRODUCTS IN A PRODUCTION LINE FOR MANUFACTURING MATS FROM FIBERS

BACKGROUND OF INVENTION

1. Field of the Invention

The invention relates to techniques for producing mineral fiber mats.

2. Description of the Related Art

Industrially, these mats are obtained by a two-stage process. The production of the fibers themselves by drawing and solidifying of a molten inorganic material in a first stage, and then association of a vast number of fibers which are brought together to constitute the mat. Between the two stages, the glass fibers or rock fibers are wetted with a binder which will be polymerized upon emerging from the second stage. Once the mat is completed, it is necessary to trim off the longitudinal edges of the strips so that they are quite clean. This operation produces a residue, the edges of the mat, which desirably should be used again. Similarly, certain waste resulting from subsequent handling of the panels or rolls constitute by-products which should be recycled.

Until now, the first operation, i.e., the recycling of the waste from the edges, was carried out by shredding the waste and returning the flock upstream of the place where the mat is created. This simple operation does, however, have two drawbacks.

Firstly, the rate of flow of waste reintroduced into the mat is not even and the wastage should not have a density which differs too greatly from that of the mat into which it is introduced. Furthermore, the time which elapses between the time when the waste is cut downstream of the line and the time when it reaches an upstream location is quite prolonged so that it is impossible to introduce waste during a change in production if the difference in densities of the products being manufactured exceeds a certain threshold.

Second, with regard to the use of waste which is produced during surfacing operations, longitudinal trimming, packaging or even dispatch, it is very difficult and often requires a lot of human intervention to prepare the waste, store it after it has been reduced to flock, to take the decision to recycle it and finally carry this out.

SUMMARY OF THE INVENTION

The invention has as an object to simplify, mechanize and generalize the recycling of all fibrous waste produced during the manufacture and exploitation of mineral fiber mats, or at least to recycle the maximum proportion thereof which is acceptable within the quality to be produced, this limit being increased in comparison with known techniques.

The reintroduction of fiber mat waste is a conventional practice both on rock fiber based mat production lines such as the mats produced by the process described in EP-A-0059152 and on the production lines which manufacture glass fibers, for instance a process of the type described in EP-A-0091866. It consists of reintroducing the waste in the form of flock when the fiber mat is being formed. In the first process mentioned above which employs a single source of fibers, the waste takes the form of flock and is injected into the receiving chute, the flock is drawn in at the same time as the fresh fibers onto the conveyor which is a perforated belt on which the mat forms.

In the other process which uses in series several fiber production units, two techniques have been used, either the introduction of scrap in the form of flock on top of the conveyor, between two fiber production heads or according to the technique described in French Patent FR 2 559 793—directly into one or more receiving chutes. Over and above the requirement connected with reducing the scrap to the form of flock, two other constraints are imposed. On the one hand, before being formed into flock, it is required that the scrap be of a density, that is to say a volumetric mass, which does not differ from the maximum volumetric mass of the mat being produced by more than a limit amount which depends on the nature and use of the mat. Furthermore, it is necessary that the quantity of recycled fibers should not exceed a certain level. This also depends on the desired quality of the mat to be produced. It is based on technical criteria such as for example the practical use for which the product is intended, or commercial criteria such as for example manufacture of a top-of-the-line or bottom-of-the-line product, etc. However this may be, in the majority of cases this level has to remain below 12%. Furthermore, it should be noted that the more the volumetric mass of the recycled fibers diverges from that of the mass, the lower is the level accepted. It can be seen therefore that the two values previously given were given solely by way of indication since they have to be combined according to vastly different technical or commercial criteria.

As has been seen, the waste can have two origins: One a systematic origin, the edges of a mat; the other random, the waste produced during use of the said mat, use which may produce waste under the most widely diverse conditions. Mostly they are due to production difficulties. It happens that products are turned out which are unsalable for one reason or another and the more the product is processed or the more sophisticated its packaging, the greater is the risk of unsalability. Thus, so-called "surfaced" products, that is to say products on the surfaces of which a facing has been glued, may suffer from the facing becoming unstuck, from tears, from faults in appearance, etc. It is then impossible to sell or even use the panel or roll produced. In this case, there are only two alternatives. Either the finished product must be thrown away or it should be substantially recycled, that is to say the fibrous part should be recycled. The first solution poses problems in connection with the environment and that is why one should make the utmost effort to re-use the fibers of such unsalable panels or rolls. Various techniques have been suggested for separating the surfacing from the fibrous material and it is assumed that they have been performed and that it is a bare fiber roll or panel which is available here. It is these fibers—like the fibers emanating from the edges of the mat—which should be recycled. The invention proposes a method of performing such recycling.

According to the invention, the method of producing the mineral fiber mat comprises the following stages. Formation of fibers from a molten material, drawing, entrainment by a gaseous flow. The stream of fibers is then directed to a conveyor which collects them and carries them. Then foreign fibrous materials selected according to their density are added to the main stream of fibers.

Furthermore, the foreign fibrous materials have been stored prior to being introduced into the main fiber stream. They are stored in silos in each of which the fibers have a clearly defined mean density.

The foreign fibrous materials are drawn from the stocks of differing mean densities in such quantities that the resulting mean density is compatible with those of the fibers in the main stream. Therefore, the invention provides for weighing or metering to be carried out at the outlet from each silo. In one and the same silo, the foreign fibrous materials are mixed according to their respective densities and quantities and regardless of their origin.

In the production process according to the invention, between the outlet from the silos and the introduction into the main fiber stream, the foreign fibrous materials are mixed and then conveyed at a constant rate of volumetric flow.

Furthermore, the method according to the invention comprises the formation of fibers from a molten material, their drawing, their entrainment by a gas flow, collection on a fiber conveyor and their transportation. Foreign fibrous materials are added to the main fiber stream, the material is formed into flock, the flock is prepared and measured out and then destructured. The destructured flock is mixed and then carried at a constant volumetric flow prior to being introduced into the main fiber stream.

According to another feature of the invention, a method of producing a mineral fiber mat comprises the steps of forming a mat of mineral fibers from a fiber bearing gas stream, producing a product from the mat, separating waste portions of the material fiber mat from the product, storing the mineral fibers from the waste portions according to their densities, metering the stored mineral fibers as a function of their weights, and adding the metered mineral fibers to the gas stream forming the mat.

Also proposed is an apparatus for carrying out the production method according to the invention. It comprises a constant level tank, an ascending spiked belt and two comb rollers at the top.

Furthermore, for a given belt speed, it is the first comb roller which defines the volumetric rate of flow. The second roller is regulated so that the essential content of the fibrous materials which have reached it is extracted.

The method according to the invention thus makes it possible to recycle the maximum possible amount of product and it makes it possible to almost entirely eliminate pollution of the environment by mineral fibers emanating from fiber mats. Furthermore, this technique makes it possible to substantially reduce production costs since in the finished product new fibers are replaced by fibers which would otherwise have been wasted.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
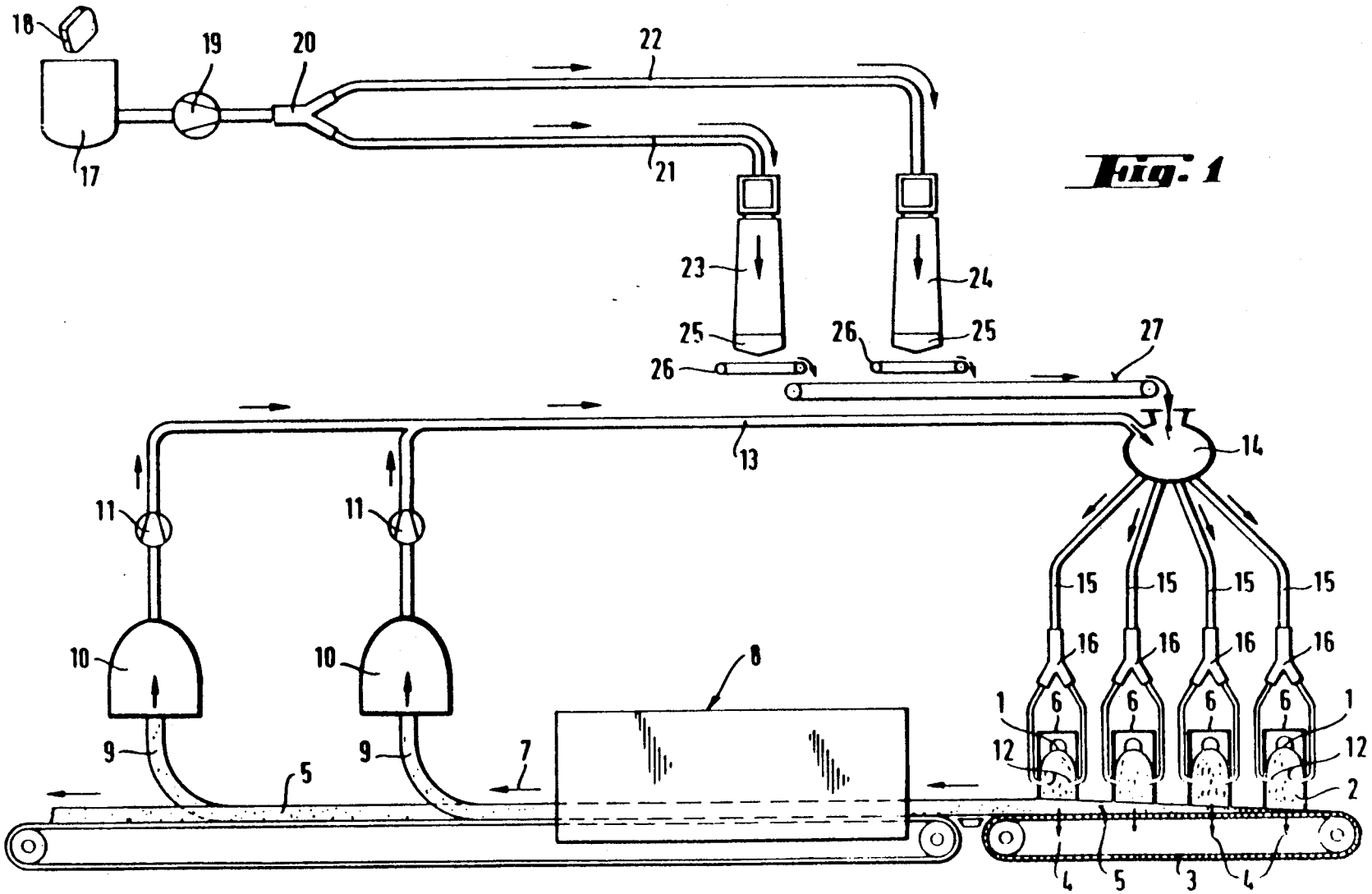
FIG. 1 is a schematic illustration of a conventional technique.

FIG. 1 shows a conventional production line for manufacturing a mineral fiber mat, in this case a mat made from glass fibers and by a method employing centrifugal treatment of a stream of molten glass through orifices in the wall of a rapidly rotating container. This method is described for example in the patent EP-A-0091866. In such a method, generally a plurality of sources of fibers are used which successively deposit layers which, being superposed, make up the fiber mat. Four of these are shown in the drawing.

Shown diagrammatically at 1 is the centrifuging apparatus which throws out a shower of fibers 2 which are deposited on the conveyor, which in this case is a perforated metal belt 3. Air 4 is drawn through the belt in such a way as to apply the mat 5 against the belt. Each centrifuging apparatus 1 is insulated from the outside by a wall 6 which constitutes an intake chute. The fiber mat 5 is entrained over a considerable length in the direction of the arrow 7. More often than not, this length is about 100 m. The system transporting the mat is not illustrated. Not shown either is the apparatus which in each intake chute makes it possible to spray onto the fibers a liquid binder which is then dried and polymerized in the enclosure 8.

The mat 5 will then be cut to constitute either rolls or panels. Shaping of the mat to arrive at the finished product first requires that the irregular longitudinal edges of the mat should be removed. On the production line, it is therefore necessary to perform a systematic longitudinal trimming of the selvedges. The thus separated waste products are conveyed to a shredder 10 which converts them to fiber flocks which range from 1 to a few centimeters in dimension. These flocks, propelled by the air supplied by a blower 11, are returned directly upstream to the place where the fiber mat is being formed. There, they are reintroduced into the mat either in between the intake chutes, or more homogeneously and according to the technique described in the patent FR 2 559 793, directly into the stream of fibers from each of the intake chutes. It is this technique of introducing fibers into the intake chute which is shown in FIG. 1, the fibers being introduced at the level of each layer of new fibers such as 2 through the ducts 12 of which there are two in each of the intake chutes. Between the blower 11 and the ducts 12 the fibers recovered therefore have to follow a long path 13 until they reach a distributor 14 which directs identical streams of recycled fibers over the four intake chutes illustrated. Thus they pass through the four ducting systems 15 before reaching distributors 16 which divide equally the flow intended for each of the ducts 12.

Under stable working conditions, that is to say when the same type of finished product is being turned out over a long period and the finished product is of the same density and the same binder is used, the flock from the edges 9 is easily introduced into the mat 5.

However, it is obvious that the time which elapses between the production of a given mat and the introduction of the waste from this mat into the intake chutes is quite long. For example, in a production line of the type shown in FIG. 1 which has four units producing 15 tonnes of fiber per day and with a mat width of 1.20 m, the mat being produced measures 60 kg/cu.m and is 10 cm thick, the time will be around 20 minutes between the production of a mat and the reintroduction of its selvedge into the fiber mat which is produced subsequently. When production is stabilized, this delay is of no importance but if the production changes and if there is a considerable difference in the densities of the two mats which makes it impossible to recycle old fibers, then there is no solution other than to keep stocks of large quantities (in the example chosen, 24 cu.m) awaiting a future identical production run or alternatively the waste in question has to be dumped. The solution entailing recycling of fibers in a furnace for melting glass or slag may likewise be envisaged but it is expensive (the fibers have to be remelted) and it may upset some of the parameters of the melting process such as the oxidation-reduction balance of the bath.

But in conventional production lines, it is likewise desirable to recycle waste fibrous materials produced off-line and resulting, for instance, from defects in manufacture. When it is desired to recycle such products after they have been separated from foreign elements such as materials used for surfacing for instance, two possibilities arise. They are compatible with the production at the time (same binder and roughly the same density) and then they can be added to the selvedges until they together constitute a specific fraction of the finished mat, for example 10%, this limit proportion being a function of the quality desired and the density of the mat produced. On the other hand, when the materials are incompatible and it is desired to re-use the waste, the only possibility outside of recycling in the furnace is storing and awaiting fresh production of material the density and/or desired quality of which will allow re-incorporation of the stored waste.

FIG. 1 also shows the finished product recycling circuit. Reference numeral 17 denotes a shredder into which are fed the panels 18 (or the rolls) from which the surfacing material has been removed. The blower 19 propels the flakes or flock in suspension in the air to the distributor 20 which—according to the original density of the panel 18 (or roll) sends them through the ducts 21 to the storage silo 23—reserved for instance for lightweight products, the others being transferred via the duct 22 to the silo 24 which may itself, in the example shown, be reserved for the more dense products.

According to the type of mat 5 (density, desired quality) which is being produced, it is possible to draw from the stock of lightweight materials in the silo 23 or from the stock of heavy materials in the silo 24. In the traditional process, in order to adjust the rate of flow of recycled products to the target value, which depends upon the quantities to be recycled and the maxima which can be tolerated, and which are themselves dependent upon the nature of the product being manufactured and the quantities of flakes or flock emanating from the selvedges which have already been reintroduced, an intermittent balance 25 is used which is permanently loaded with flock and which then empties when the load reaches a preset weight. The entire load is then tipped onto moving belts 26 and 27 and will finally join the material on the path 13 due to the action of a blower, not shown. The path followed by this second group of waste materials is then the same as that of the waste which comes from the selvedges.

The waste recycling system which has just been described and which would make it possible to recycle the maximum possible amount of waste on a line which is devoted to a single type of production does, as we have seen, suffer from many disadvantages. Of these, some relate to the recycling of the trimmed edges when there is a change in program as explained hereinabove, because it happens that one program may last less than an hour. The others relate to the measured dispensing and assimilation of waste from finished products. The first stage of the cycle, that which starts with the introduction of the panel 18 into the shredder 17 and which finishes with storage of the flock of lightweight products in the silo 23 and of the dense flock in the silo 24, normally takes place without problem. It is the second part, between the taking of material from the silos and introducing it into the distributor 14, which poses serious problems connected with the measured dispensing of waste.

As above, let us consider the example of a mat based on dense products and 1.20 m wide, with the four centrifuging units shown in FIG. 1. In the example, trimming of the edges produces 8% waste which is continuously recycled by means of the ducting system 13. Here, production is intended for an end use which will tolerate for instance 12% waste. Therefore, it would have been possible to introduce a maximum of 4% waste from the silo 24. The theoretical flow to be introduced, in view of the above-defined parameters, is 1.6 kg/min. The balances 25 operate as follows: At the outlet from the silos, a rate of flow of flock is stabilized at approximately the desired rate of flow, and at regular intervals the exact load desired is released and falls onto the moving belt 26. In the example in question, it is a load of 530 g which falls every 20 seconds. Therefore, such a system provides a good average rate of flow but it is a rate of flow which varies substantially from one moment to another. During the course of subsequent transport, the divergences will be smoothed out slightly but there is nevertheless a fluctuation about the target value in the overall quantity of recycled flock. As it is vital not to exceed a level of 12% in this instance for commercial reasons, one is compelled to reduce the mean quantity of recycled flock from silo 24 to 10% for example in order to be certain never to exceed the maximum tolerance.

The conventional methods of recycling waste emanating from faulty finished products are limited by the difficulties of assimilating flock of foreign origin into the mat. Indeed, flock which has been stored in silos 23 and 24 will be extracted and then transported and finally mixed as such to the stream of new fibers. It therefore remains in the same form in the finished mat, where it constitutes a quite substantial heterogeneous factor.

Figure 2:
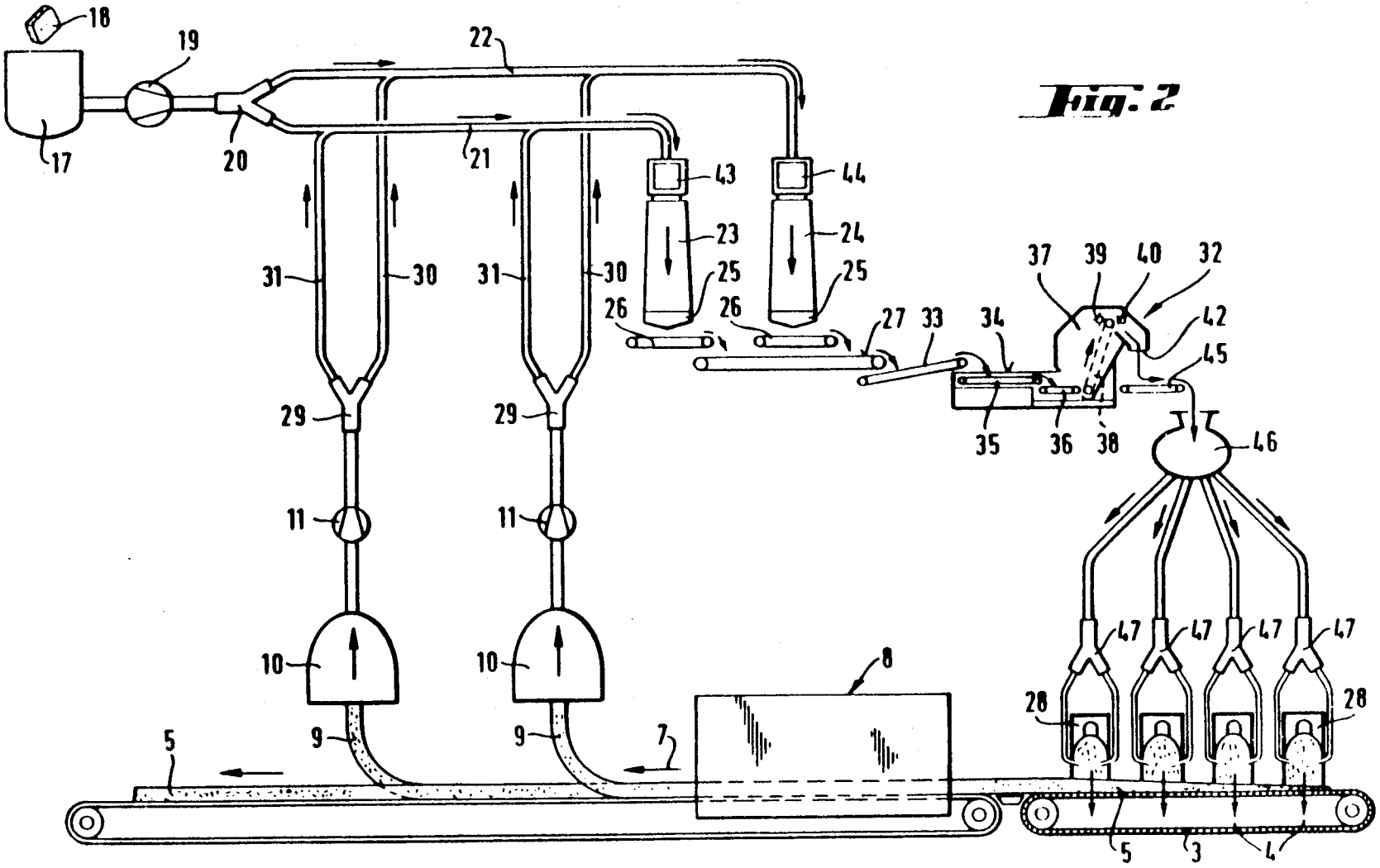
FIG. 2 is a schematic illustration of a technique according to the invention.

FIG. 2 shows the process according to the invention for preparing, selecting, storing, dispensing and destructuring and then finally distributing the waste, whether it comes from selvedges on the production line or from scrap or off-line faults. Certain elements are the same as those in FIG. 1, particularly everything which is connected with the actual production line, from the intake chutes 28 to the mat 5 at the end of the line. The processing of the longitudinal selvedges 9 employs the shredders 10 and the blowers 11.

Here, the shredders are supplied as follows:

The edge, trimmed off by saws, discs or water jets, engages a horizontal duct followed by a vertical or oblique duct terminating at the crusher installed either under the line or preferably in the cellar, which facilitates the handling operations and reduces the noise. There is one crusher for each edge. The minimum length of the horizontal duct is 500 mm and its cross-section will for example be 340×350 mm.

Upstream of the horizontal duct, a motor-driven wheel beds the edge down flat, compressing it. This avoids the edge breaking up downstream of the trimming saw. The length of the vertical or oblique part is approx. 2.5 m (according to the cellar depth).

According to the width of the product, the distance between the horizontal ducts may be regulated by means of two motors and two screw-and-nut assemblies.

At their top end, the vertical ducts have a cone which makes it possible to keep the vertical part fixed, despite the variation in distance between the horizontal ducts.

As a shredding arrangement, hammer mills are used. The mill consists of a rotor 450 mm in diameter and 400 mm long. It comprises 90 hammers distributed over three rows; its speed of rotation is around 1500 revolutions per minute. The grille is of manganese steel and measures 40×40 mm.

At the outlet from each shredder, a fan 11 draws off the flock.

The specifications of the fan are calculated in order to achieve a speed of 20 m/sec in the pipes of 200 to 250 mm diameter, in other words a rate of flow of about 3500 cu.m/h, the total pressure being calculated as a function of the losses of head due to the positioning of the piping.

The materials used for the impeller and the casing have a good resistance to abrasion.

At the outlet from the fans, there are distributors 29 which are capable of orientating the flock either to the duct 30 if, for example, it is light in weight, or to the duct 31 if it is more dense. It rejoins the main circuit 21 if it is lightweight or 22 if it is heavy, being directed to silos 23 or 24, respectively.

The circuit for scrap or finished products resulting from manufacturing defects 18 includes shredder 17, blower 19, distributor 20 and then main ducts 21 or 22 which consist of elements which are exactly the same as those which have just been described. It can be seen in FIG. 2 that after separation according to density, the selvedge circuit has rejoined the scrap and faulty goods circuit in order to constitute a single circuit, that of the foreign fibrous materials. Passage into silos such as 23 or 24 is therefore systematic. These silos are for example cylinders with a vertical axis and with a capacity of 4 cu.m each. Each is topped by a condenser 43, 44 which makes it possible to separate the air from the flock. They are fitted with filters to eliminate dust before the air is recycled. In the drawing, by way of example, only two silos are shown silo 24 for dense products, the other 23 for light products. During the course of tests, the light product/heavy product threshold was set at a volumetric mass of 20 kg/cu.m.

The distributors 20 or 29 on each of the flock feeding circuits are selectively switched according to the volumetric mass of the flock being fed to them, either to the duct 21 if it is of low density or to the duct 22 if its volumetric mass exceeds the fixed limit. This limit depends on the range of products produced on the lines (in the case of FIG. 2, it may range from 8 to 110 kg/cu.m) but it also depends on the respective quantities produced with the different densities, just as it also depends on the proportions of additions of differing tolerated density which varies according to the end use of the product. A fiber intended to constitute a filler in a bitumen does not have the same demands from this point of view as that which is going to be used for a roll intended for the insulation of a roof space for example.

The number of silos shown in FIG. 2 is two but it is obvious that a finer classification of flock to be recycled may be of interest. Then, the number of silos is increased which makes it possible to improve the grading among the respective densities of recycled flock and mats in production.

When it leaves the silos (23, 24) the rest of the path followed by the flock is identical to that in FIG. 1 which shows the sequence of balances 25, moving belts 26 and the main moving belt 27. The essential new element in the circuit is the machine 32. This is a so-called "bale breaker" machine and it fulfills many functions. Firstly, the conventional function of this type of machine is to break up the tangled fibers. Indeed, during the course of the repeated earlier handling, the flock may have been compacted, condensed and imbricated, and it is necessary to try to get the flocks to resume their original configuration so that they will integrate all the more readily into the new fibers. It is even desirable to go farther than this, to destructure the flock or cause it to "burst open" to facilitate integration into the stream of new fibers and therefore into the mat. A second function of this machine which is not normally required of bale breakers is that of homogenizing the flock when it comes from more than one origin, i.e., selvedges or finished products or flock of the same type which has a different history from another of that type.

A third and completely new function is also met by this machine. The function is new because the problem posed here is not normal in the kind of workshop where such machines are installed. The function is to maintain constant the rate of flow from the balances 25, a rate of flow which varies periodically as we have seen. It is necessary to "smooth out" the cyclic fluctuations so that an excess flow in relation to the average rate of flow makes up for any short fall. Thus, a constant volumetric flow can be obtained.

Figure 3:
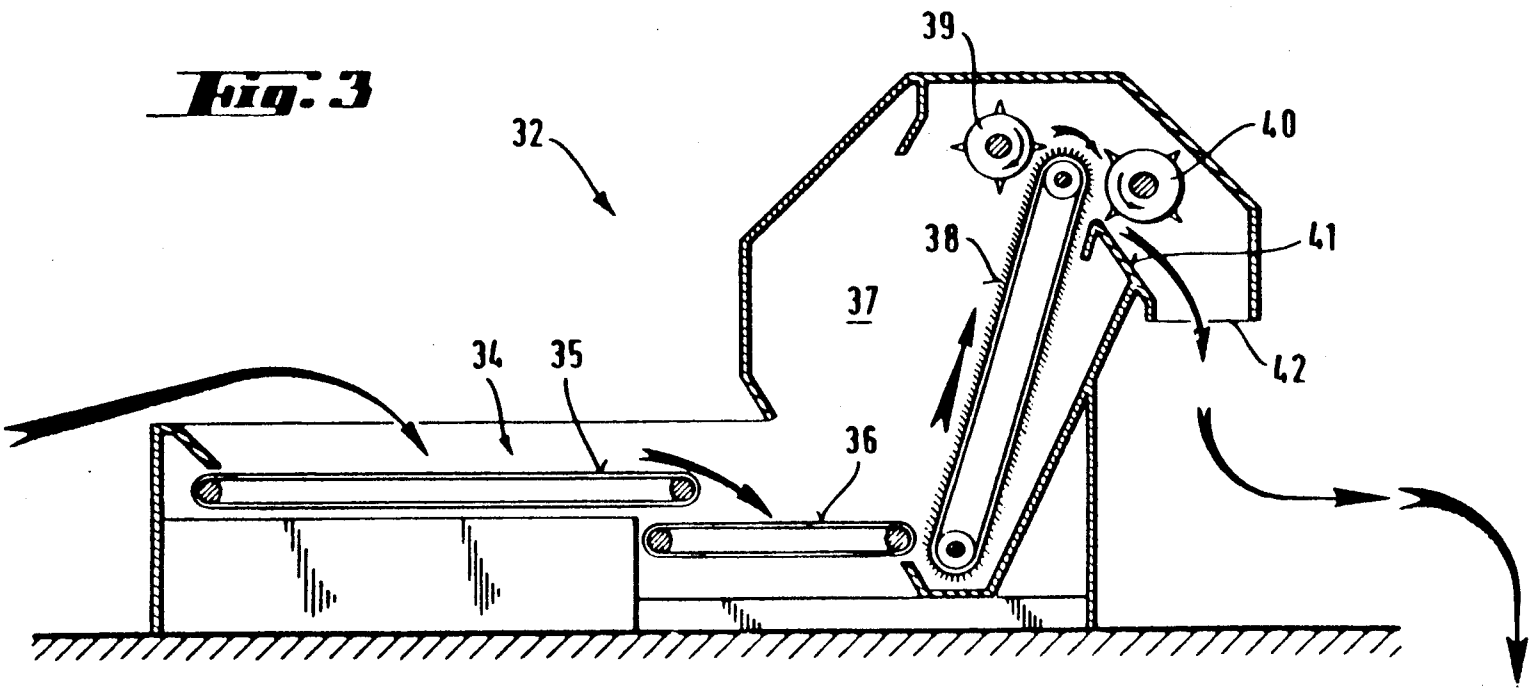
FIG. 3 schematically illustrates a machine used for preparing and dispensing flock according to the invention.

The machine 3 is shown diagrammatically in FIG. 3. The product leaves the moving belt 33 which is shown in FIG. 2 and which has raised the flock above the machine 32. The entrance to the machine at 34 takes the form of a trough, the bottom of which consists of the moving belt 35. This latter is driven at a constant speed and the flock will therefore be deposited periodically on it as it is delivered by the operating balance 25.

This moving belt 35 in turn supplies a conveyor belt 36 which constitutes the bottom of a constant level tank; indeed, it is equipped with an ultrasonic system, not shown, which allows the flock of foreign fibrous materials loaded on it to assume a constant thickness. As soon as the chosen level is attained, the motor which drives the moving belt 35 stops and the fiber feed is immediately stopped. In this way, the flock occupies in the tank 37 a clearly defined level which is chosen so that the fibers are entrained upwardly at a constant rate of flow which corresponds to the average weight for which the balance 25 is calibrated. This upwards entrainment is carried out by the spiked belt 38 which moves at a constant speed. This speed may be adjusted by a manual control, not shown.

At the top of the spiked belt, the flock reaches the comb roller 39 which has four generatrices fitted with spikes and which turns in the opposite direction, propelling downwards any excess flock and so ensuring a perfectly regular flow of fibers. Furthermore, the teeth of the combs penetrate the flock which is held by the spikes on the belt, producing the desired "destructurizing" effect. A second identical roller 40 which turns in the same direction as the flow fulfills a related function and extracts all the fibers from the spiked belt and sends them onto the inclined surface 41 towards the outlet 42 of the machine.

Underneath this outlet is the conveyor belt 45 which feeds a fan, not shown. This latter sends a regular flow of foreign fibrous materials delivered by the machine 32 to the distributor 46 which feeds as many ducting systems as there are intake chutes 28. Prior to distribution into each chute, once again, distributors 47 separate the flow of recycled fibers into two equal flows which, two by two, supply the intake chutes where they are blended with the main stream of fibers.

Thus it is evident that using the machine 3 makes it possible to deliver a constant and well-defined volumetric flow since it corresponds to the weighing carried out by the balance 25.

Therefore, the invention makes it possible to supply rock fiber or glass fiber production lines immediately after the fiber producing machines with a regular rate of flow of open and destructured flock. These two elements—regular supply and destructurizing of the flock—each play their part in facilitating incorporation of foreign fibers into the flow of new fibers. Thus one can always choose if necessary the maximum rate of flow of recycled fibers compatible with the criteria of quality which are, as we have seen, a function of the nature of the products manufactured, their final destination and the nature of the fibers to be recycled.

The following examples will make it possible to see how storing foreign fibrous materials in silos in which the average density is defined makes it possible to control the mean density of the fibers reintroduced into the main fiber stream.

EXAMPLE 1

On a glass fiber line with a centrifuging unit comprising four fiber producing heads and which produces 60 tons per day of 1.30 m gross width, for an effective width of 1.20 m, there is consequently around 8% waste at the edges. At that point in time, the supply of waste from finished products is zero. The line is equipped with two storage silos, silo A for lightweight products and silo B for dense products. At the moment in the example, the limit density between A and B was 30 kg/cu.m and the mean density in silo A was:

$$d_A = 20 \text{ kg/cu.m}$$

and in silo B:

$$d_B = 60 \text{ kg/cu.m.}$$

The production envisaged within the example was that of a very dense product $d_f = 90$ kg/cu.m. It is found that in view of the market for which the product is intended and above all its conditions of use, solely in compression, there is no problem of cohesion of the mat and the tolerated proportion of lightweight flock is considerable.

Empirically, it has been found that by using the techniques according to the invention, this proportion may be as much as 8% by volume with a product of which the density is equal to that of the mat being produced, that is to say equal to $d_f$ but that it can rise as far as 15% if its mean density is 15 kg/cu.m. Interpolation between the two is possible, that is to say for example if one desires to reintroduce flock having an average density of 30 kg/cu.m, it is possible to reintroduce 13.5% of such flock, while if its density is 60 kg/cu.m, then 11% is possible. In the actual case referred to in the example, this latter possibility is chosen so that all the products to be recycled are taken from silo B, the balance of which has been adjusted to deliver on average 275 kilos per hour. The machine 32 in FIG. 2 is regulated in such a way that it guarantees precisely the constant volumetric rate of flow of the quantity required. By making this choice, the store of waste contained in silo 8 is slightly lowered. Indeed, the quantity introduced per hour (in silo B since its density, 90 kg/cu.m, is greater than the fixed limit, 30 kg/cu.m) corresponds to 8% of the production while the quantity extracted is 11%. Furthermore, the mean density of the stock increases. This parameter—control of the stocks of waste—is added to those already evoked. It forms part of the elements to be considered before choosing the average density and the quantity to be reintroduced.

EXAMPLE 2

The glass fiber production line according to the method disclosed in European Patent EP A 0091866 comprises six centrifuging heads with an output of 120 tonnes per day. The net width is 2.40 m and the edge waste constitutes 4% of the output. This is stored in three silos A, B and C of which the mean densities are respectively $d_A = 12$ kg/cu.m, $d_B = 20$ kg/cu.m and $d_C = 50$ kg/cu.m.

On the day of the example, production was that of a mat with a density of 30 kg/cu.m and the contributions of finished products to be recycled which it is necessary to introduce into the silos consisted of a quantity of 200 cu.m per day of a density of 10 kg/cu.m. For reasons of production control, it is desired here to retain the same mean density in silo B and so it will be necessary to introduce into this latter all the waste emanating from the edges (200 kg, in other words 6.7 cu.m/h) and the same volume of waste from finished products with a density of 10 kg/cu.m will be introduced. The remaining waste from finished products will be stored in silo A where the average density will be lowered slightly. The product manufactured on the day in question accepted 8% by volume of waste but with an average density close to that of the product being produced. Therefore, a flow of 8.9 cu.m/h (178 kg) has been drawn from silo B and 4.4 cu.m/h (220 kg) from silo C, these quantities being mixed and, after equal distribution, introduced into the receiving chutes of the six fiber producing units.

But it would have been equally possible to draw a volume c from silo C and a volume a from silo A such that:

$$a + c = 13.3$$

$$13.3 \times 30 = 13\,a + 50\,c$$

from which one deduces that a = 7 cu.m/h and $c = 6.3$ *cu.m/h.*

Thus one sees that there are numerous possibilities in the choice of parameters which, thanks to the invention, are available to the production manager.

Therefore, the technique according to the invention makes it possible not only permanently to reintroduce the waste originating from the edges of the mat whereas prior art techniques made it necessary to interrupt such reintroduction when there was a change in production, but in addition it allows the recycling of waste of whatever origin and of whatever fiber type. The only constraint is that one must have available a sufficient storage capacity to wait until production is compatible with the nature of the fibers which it is desired to recycle.

The systematic recycling of fibers emanating from finished products is particular favorable to preservation of the environment.

Furthermore, by making it possible to reintroduce the maximum acceptable quantity of recycled fibers, there is a considerable saving in production cost. Indeed, in the finished product, newly produced fibers are replaced by fibers which would otherwise have been disposed of and which have cost nothing and which have made it possible to eliminate the costs which their disposal would have entailed. The additional cost is limited to that of conversion of the finished product into flock which can be stored in silos and the cost of a few subsequent handling operations.

Thus the progress achieved in the field of environmental protection is reminiscent of that of the eighties when the industrialized countries recycled glass bottles.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of producing a mineral fiber mat, comprising the steps of:

forming a mat of mineral fibers from a fiber bearing gas stream;

producing a product from the mat;

separating waste portions of the mineral fiber mat from the product;

storing the mineral fibers from the waste portions according to the densities thereof;

metering the stored mineral fibers as a function of the weights thereof; and adding the metered mineral fibers to the gas stream forming the mat.

2. The method of claim 1 including the step of destructurizing the metered mineral fibers prior to said adding step.

3. A method according to claim 2, wherein the destructurized foreign fibrous materials are mixed and entrained at a constant volumetric flow prior to said adding step.

4. The method of production according to claim 3, including a constant level tank which receives the metered fibers, a spiked and ascending belt and two comb rollers at the top of the belt for delivering the fibrous material to the fiber stream.

5. The method according to claim 4, wherein a first of said comb rollers defines the volumetric rate of flow of the fibrous material.

6. The method according to claim 5, wherein the second comb roller is regulated in such a way that it extracts essential parts of the fibrous materials.

* * * * *